US006131359A

United States Patent [19]

Duff

[11] Patent Number: 6,131,359

[45] Date of Patent: Oct. 17, 2000

[54] STIFFENING CLIPS FOR FLOOR JOISTS AND METHOD FOR USING THE SAME

[76] Inventor: Owen D. Duff, 14 Saran Ave., Bedford, Mass. 01730

[21] Appl. No.: 09/290,434

[22] Filed: Apr. 13, 1999

Related U.S. Application Data

[63] Continuation-in-part of application No. 09/212,212, Dec. 15, 1998, abandoned.

[51] Int. Cl.[7] ..... E04C 5/00

[52] U.S. Cl. ..... 52/706; 52/709; 52/710; 52/696; 52/690; 52/514

[58] Field of Search ..... 52/706, 709, 710, 52/711, 698, 635, 696, 731.7, 693, 712, DIG. 6, 695, 638, 514, 690

[56] References Cited

U.S. PATENT DOCUMENTS

| | | |
|---|---|---|
| 459,900 | 9/1891 | Moore . |
| 682,086 | 8/1901 | Kearney . |
| 866,140 | 9/1907 | Kahn . |
| 1,204,956 | 11/1916 | Day . |
| 1,509,011 | 9/1924 | Whiteside . |
| 1,514,577 | 11/1924 | Burrell . |
| 1,609,699 | 12/1926 | Coryell . |
| 1,649,226 | 11/1927 | Gstalder . |
| 1,725,414 | 8/1929 | Parish . |
| 1,729,741 | 10/1929 | Heltzel . |
| 2,455,904 | 12/1948 | Meulenbergh . |
| 2,623,246 | 12/1952 | Pestak . |
| 2,914,816 | 12/1959 | Lundgren . |
| 3,108,406 | 10/1963 | Ellis . |
| 3,335,993 | 8/1967 | Tuttle . |
| 3,979,093 | 9/1976 | Madden . |
| 3,991,535 | 11/1976 | Keller et al. . |
| 4,122,647 | 10/1978 | Kovar . |
| 4,246,736 | 1/1981 | Kovar et al. . |
| 4,679,374 | 7/1987 | Boehmig . |
| 4,708,554 | 11/1987 | Howard ..... 411/84 |
| 4,794,746 | 1/1989 | Ramer . |
| 4,947,612 | 8/1990 | Taylor et al. . |
| 5,230,190 | 7/1993 | Schuette . |
| 5,301,486 | 4/1994 | Taylor . |
| 5,519,977 | 5/1996 | Callahan et al. . |
| 5,546,716 | 8/1996 | Broxterman et al. . |
| 5,850,721 | 12/1998 | Martin . |

*Primary Examiner*—Christopher T. Kent
*Assistant Examiner*—Jennifer I. Thissell
*Attorney, Agent, or Firm*—William A. Loginov; Cesari and McKenna, LLP

[57] ABSTRACT

A spacer clip for securing side-by-side joists and a method for using such clips is provided. The spacer clip, constructed from sheet metal or a rigid composite includes a bridging section and a pair of legs that extend transversely to the bridging section. A draw bar is provided along the legs at positions remote from the bridging section. The draw bar is movable to vary the pressure applied by the legs to confronting sections of joists. The draw bar can be locked in a pressure-applying orientation with respect to each of the legs. In this manner, the joists are spaced by the bridging section at one end of their height and the draw bar pressurably spaces them at an opposing end of their height.

8 Claims, 12 Drawing Sheets

STIFFENING CLIPS FOR FLOOR JOISTS AND METHOD FOR USING THE SAME

RELATED APPLICATION

This Application is a continuation-in-part of U.S. patent application Ser. No. 09/212,212, filed Dec. 15, 1998 abandoned.

FIELD OF THE INVENTION

This invention relates to building construction product and more particularly to a bridging product for strengthening floor joists primarily in wooden structures.

BACKGROUND OF THE INVENTION

In the construction of wooden frame buildings it is common to set evenly spaced floor joists, typically formed from nominally dimensioned 2×8–2×12 ("two-by-eight to two-by-twelve") lumber on foundations or wall headers to define a floor surface. These lumber pieces are laid in parallel, spaced typically at a sixteen-inch on-center spacing. The lumber pieces in such an arrangement are known as joists. They are set so as to span a floor or ceiling space with the nominal two-inch (e.g. "two-by") dimension extending in a horizontal (widthwise) direction and the nominal eight to twelve inch (e.g. "eight-by to twelve-by") extending in a vertical (heightwise) direction. In this manner, the joists each define a load-bearing beam for supporting a portion of the weight of the floor/ceiling. Over the joists are typically placed sheets of wafer board, plywood, solid planks, or another suitable natural or man-made subfloor material. Over the layers of subflooring can be placed finish flooring such as tile, carpeting or hardwood strips. The subfloor is secured to the joists against the "two-by" dimension face of the joists using nails, screws and/or adhesives. The subfloor pieces are often joined together at tongue and groove edge details that interlock with each other to define a fairly even, level and smooth subfloor surface.

It is highly desirable to maintain a stable joist-to-joist spacing along the entire span length. It is further desirable to maintain the parallelism of the joists along the vertical direction. In this manner, the placing of subfloor pieces is more predictable and accurate. It is further desirable to maintain the parallelism and spacing between joists so that the floor does not subsequently move, acquire dead spots.

One common problem encountered with floors, subsequent to installation, is that the joists become non-parallel. For example, the ends of the joists that are opposite to the subfloor (in the vertical direction) can become splayed through curling or warping of the wood. This can cause torsion and detachment of joists from the subfloor. This results in dead spots, and waves that show up in the finished floor.

The tried and true technique for preventing curling, and for ensuring evenly-spaced, parallel joists is to install solid blocking between each pair of adjacent joists along the center of the span and, possibly, at other portions of the span. These blocking pieces are, in essence, sections of joists that have been cut to the appropriate joist spacing (16 inch or other on-center spacing) and that run the full vertical width of each joists. Typically these blocks extend transversely to the span direction of the joists and are secured by through-nailing each of the joists to pin opposing ends of the blocking into place. Blocking pieces are staggered by a few inches along successive adjacent joists to provide space to through-nail each blocking piece. A disadvantage of blocking is that it is time consuming to install. Each piece must be individually measured, cut, placed and nailed at several points along the vertical height of the joist. Wherever a blocking piece is installed, holes must be cut to allow mechanical systems such as wires and pipes to pass therethrough. Such holes may weaken the structural integrity of the blocking piece, and are time consuming to cut.

An alternate technique for attempting to secure joists together involves the use of crossed pieces of wood each cut on an angle. The crossed wood members, known generally as "bridging," may be formed from solid wood pieces or composites such as plywood and waferboard. A bridging structure according to the prior art is detailed in FIG. 1. Pieces of bridging 20 are placed together at appropriate locations along the span between each of two joists 22 to form an X-shaped bridging structure. The pieces 20 are located between joists 22 beneath the subfloor 23. Nails 24 are driven through the bridging pieces 20 so that they pass into the adjacent joists, thus securing the pieces in place. These bridging pieces 20 are often cut en masse to a single uniform length. A uniform cut length can be used since slight variations spacing between joists are accommodated by slightly increasing or decreasing the acute intersection angle (A) of the "X." The completed X-shaped bridging structures have an advantage over blocking in that they more freely allow mechanical to pass therethrough. However, they are notoriously weak and tend to pull apart over time. See, for example, the arrows 30 which show the pulling apart of bridging pieces 20 as joists 22 curl (arrows 32). The bridging offers little resistance to such curling.

It is, therefore, an object of this invention to provide a joist-securing spacer clip, and associated method for securing joists together with such spacer clips, that maintains the parallelism and spacing between joists along their span. A spacer clip of this type should be easy and inexpensive to produce, universally applicable to a variety of sizes and layouts of joist work and should allow the relatively free passage of mechanical system components (pipes, conduits, etc.) therethrough. A method for installing such spacers should be straight forward and relatively quickly for workers of average skill in the construction art, and should employ a minimum of external fasteners.

SUMMARY OF THE INVENTION

This invention overcomes the disadvantages of the prior art by providing a preformed spacer clip, typically constructed from metal or a rigid synthetic that is inserted downwardly, in a vertical direction onto the tops of joists, prior to placement of the subfloor. The clips are seated against the top of the joists along the narrow widthwise, "two-by" dimension. The clips include a draw bar seated within a pair of opposing legs that, after placement of the clip, is forced vertically downwardly in a somewhat rotary motion until it applies sufficient holding pressure between adjacent joists. In a preferred embodiment, each leg of the clip include detents for securing the draw bar in each of a plurality of predefined positions. These detents prevent the draw bar from becoming disengaged under normal conditions. The clip can include a central bridging section that spans the upper surface between joists and, typically, comes into contact with the subfloor. A leg extends downwardly from the bridging section on each side thereof. The legs extend generally transversely to the bridging section along the height direction of the joists. According to one embodiment, the legs define a V-shape and the leg ends opposite the bridging section form the base of a V. The tip is spaced downwardly from the bridge section at a distance that is equal to or less than the vertical width of the joist so that it does not interfere with ceiling or other surfaces placed on the bottom portion of the joist. The leg extends upwardly from the V-tip to a pair of mounting bases that extend outwardly in opposite direction. The outlying mounting bases or "ends" are arranged to lay on the top edges of each of the adjacent joists. The base ends can include notches or other structures that receive nails, screws or other securing devices. The base ends prevent the spacer clip from dropping vertically between the joist passed a predetermined point. The bases extend outwardly from each other a distance that is usually less than one-half the width of the joist tops so that spacer clips can be placed adjacent to each other in a line running transversely to the spanned direction to the joist.

The draw bar can be formed from a solid piece of metal, plastic or wood rod material or can be formed as a channel member. It can be slidably, but permanently secured to a slot in each leg or can be freely removable from one or both legs. The outlying bases/ends of the clip can be secured to the joists using separate fasteners as described, or integral fasteners can be provided to bases. Such fasteners can comprise preformed spikes or deformable pointed tabs.

According to a preferred embodiment, the legs can comprise straight members, formed from a solid piece of sheet metal, as bent-down, right-angled sections that each extend from a respective opposing edge of the central bridging section. The ends of the central bridging section define continuous bases ("ends") for mounting to the top of each joist. The ends are centered within the width of the bridging section while the outlying portions of the width are bent to define supports for the respective leg. In this manner, the legs and ends can be formed from a single piece of sheet material (preferably galvanized sheet steel). The central bridging section also includes side wings folded downwardly for added rigidity. The central bridging section can also include a series of perforations along its top for assisting in the attachment of plywood flooring (decking) thereover using, for example, adhesives. The perforations allow the adhesive to spread and flow thereinto.

One of the legs preferably includes a slot that is located near the leg bottom (near the side of the joist opposite the side adjacent the bridging section). This slot is located inwardly of the widthwise edges of the leg. Opposing slots at selected spacings are placed on the other leg. Each slot can be formed with an inwardly angled (with respect to the opposite leg) louver. The single slot captures a flat projecting end of a sheet metal draw bar, while the louvers are arranged to capture the opposing projecting end of the draw bar as it is pulled downwardly, pivoting about the single slot. When the draw bar pressurably engages each leg, the adjacent projection is brought into lockable contact with the closest louver to permanently secure the structure. Additional locking fasteners can be used to secure the structure if desired.

BRIEF DESCRIPTION OF THE DRAWINGS

The foregoing and other objects and advantages of the invention will become more clear with reference to the following detailed description as illustrated by the drawings, of which.

DETAILED DESCRIPTION

Figure 1:
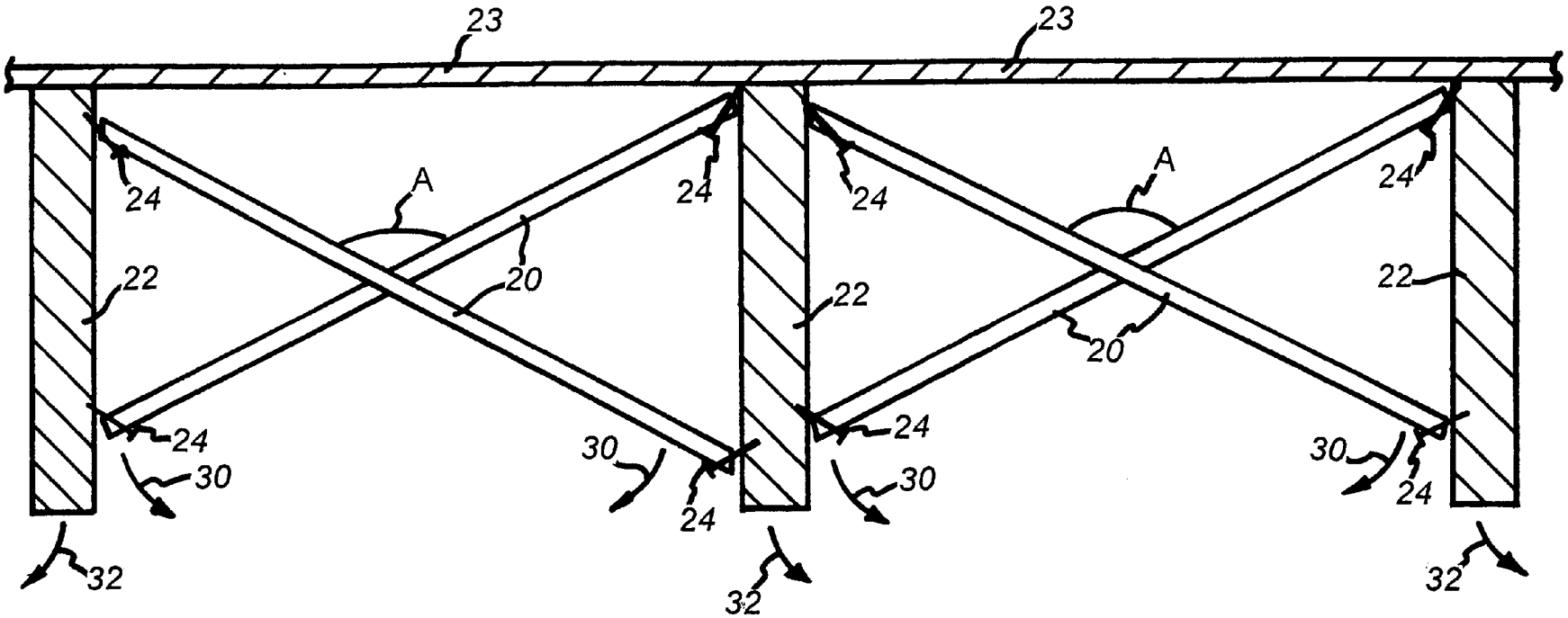
Fig. 1 (PRIOR ART)
FIG. 1, already described, is side cross-section of a floor joist bridging structure according to the prior art.
Figure 2:
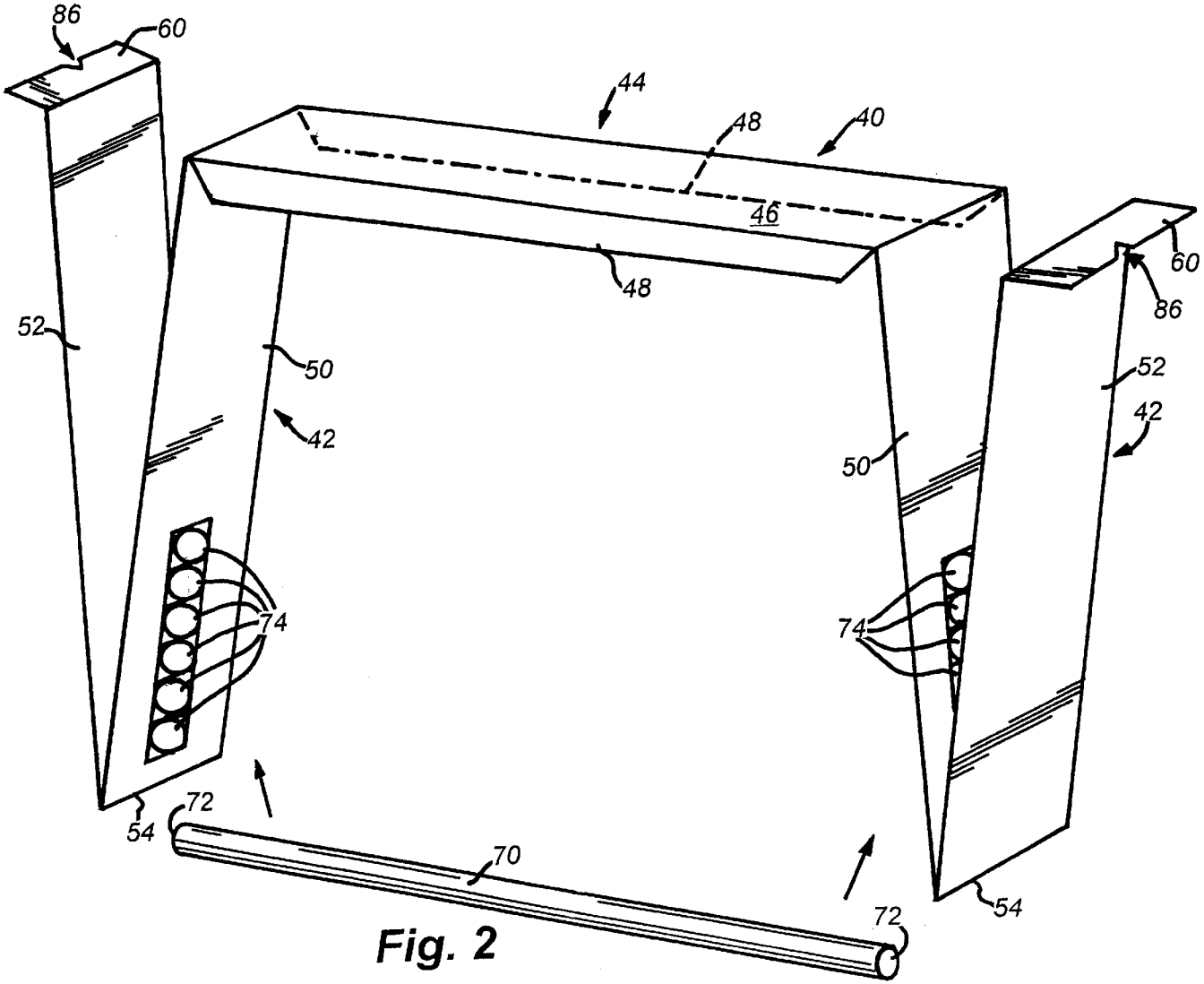
FIG. 2 a somewhat schematic perspective view of a floor joist spacer clip according to an embodiment of this invention.

FIG. 2 illustrates a floor joist spacer clip according to a preferred embodiment of this invention. The clip 40 comprises a pair of approximately vertical leg sections 42 each joined to opposing ends of a horizontal bridging section 44. The bridge section 44 comprises a flat top 46 and, in this embodiment, a pair of vertical side plates 48 (one of which is shown in phantom). The side plates 48 are optional, and variety of other stiffening structures (or no stiffening structure) can be used on the bridging section 44 according to alternate embodiments. The legs each define a V-shape with an inner leg section 50 and an outer leg section 52. Each of the legs are joined at an intersection fold 54. This fold 54 is, in essence, the base of the V. The top of each V leg section 52 includes a clip end 60. Each clip end is bent outwardly, away from the bridging section 46.

A draw bar 70 having a pair of opposing ends 72 is provided. This draw bar is arranged to mate with a series of detents 74 formed in each of the opposing inner legs 50. The detents 74 located adjacent the bottom 54 of the V.

Figure 3:
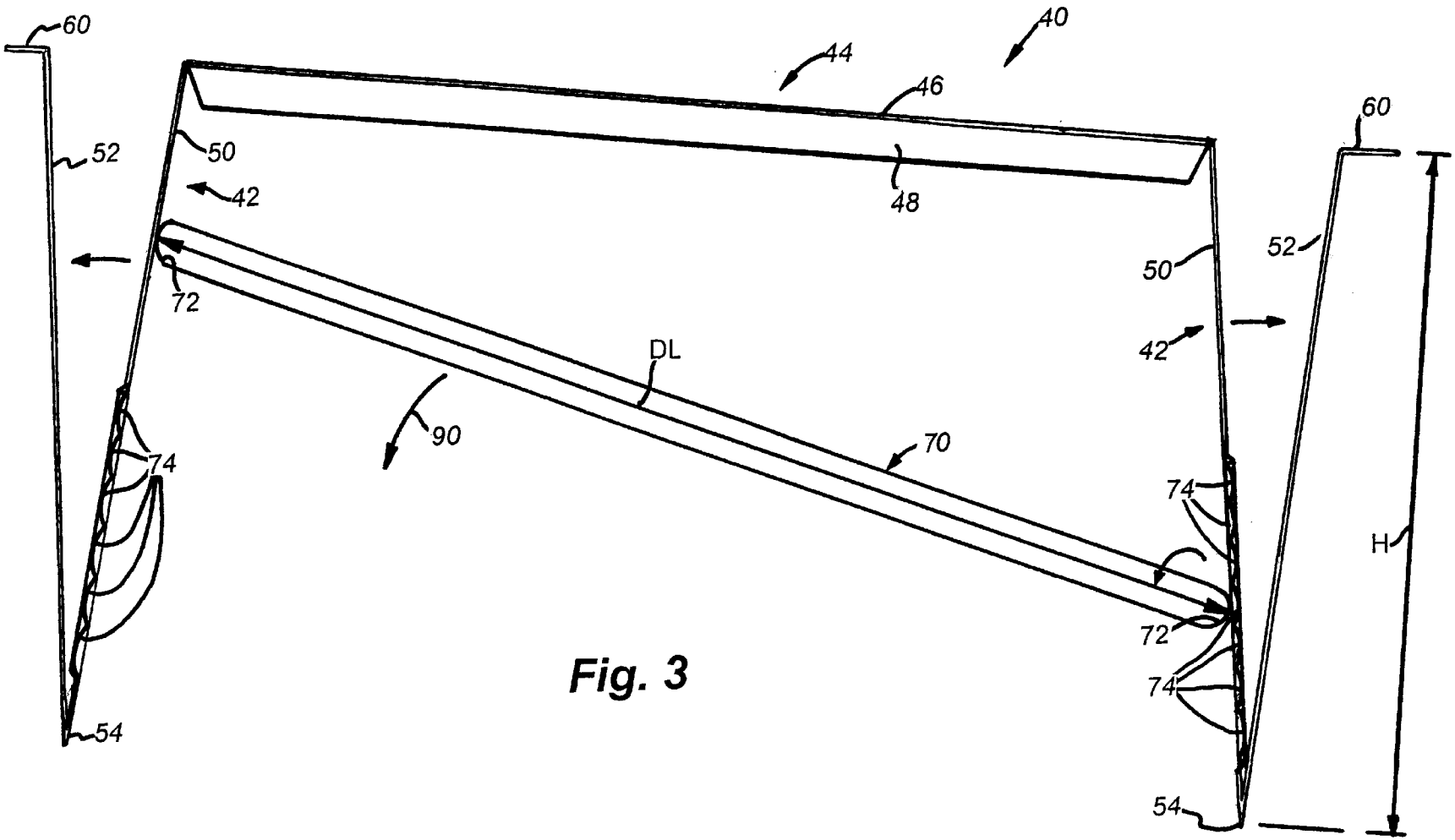
FIG. 3 is a side view of the floor joist spacer clip of FIG. 2.
Figure 4:
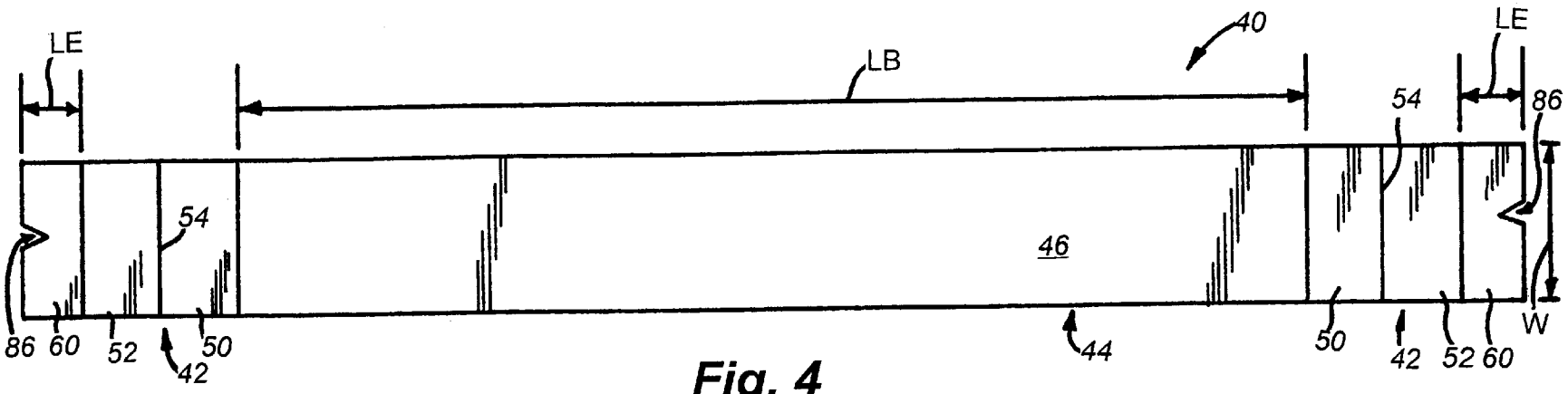
FIG. 4 is a top plan view of the floor joist spacer clip of FIG. 2.

With further reference to FIGS. 3 and 4, the dimensions of the clip, according to a preferred embodiment, are detailed. The length of the bridging section 44 is designated as LB. This length LB is between approximately thirteen and fourteen inches, approximately. LB is the distance between facing sides of joists in a conventional sixteen-inch on-center arrangement. Note that the distance LB can be varied to accommodate other joist spacings that will be described further below.

The ends 60 each have a length LE of approximately ⅝ inch. This length can be slightly more or slightly less, but is typically chosen so that it is less than one-half the "two-by" dimension of a standard joist. The width W of the clip 40 can vary widely. In one embodiment, this width is approximately two-inches. Greater or narrower widths are expressly contemplated. The height of the clip (e.g., the length of the V)

is designated as H. The height H is highly variable, but is typically no more than eight to twelve inches. Again, this height is chosen to match the approximate nominal height in vertical direction of a joist.

With particular reference to FIG. 3, the draw bar 70 has a length of DL that is generally greater than the length LB of the bridging section 44. In one embodiment, the length DL can be approximately one-half inch greater. Alternately, it can be nearly the same as the length LB. Typically, the length DL is not substantially smaller than LB-typically not smaller than the material thickness of the two leg sections 50 and 52 of the V. Otherwise, it will not fully span the gap between the legs.

Figure 5:
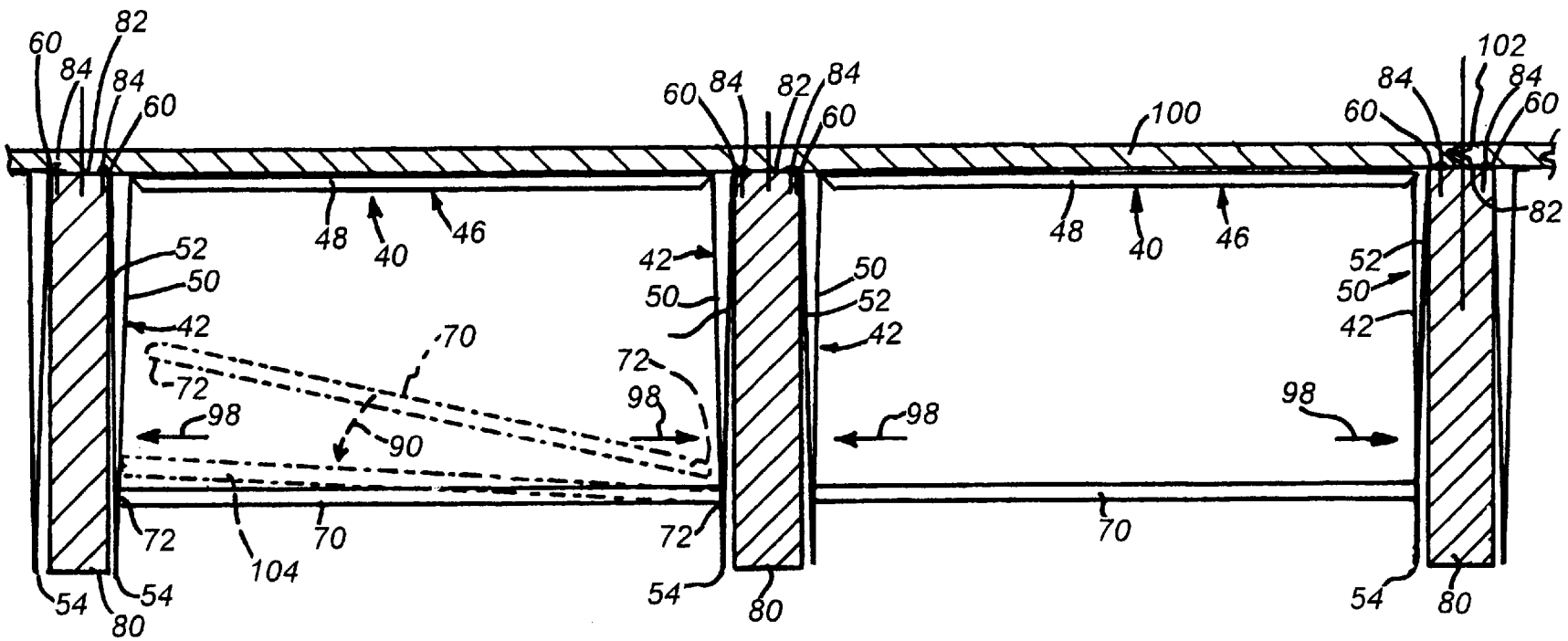
FIG. 5 is a side cross-section of joist spacer clips installed in a floor joist section according to this invention.
Figure 6:
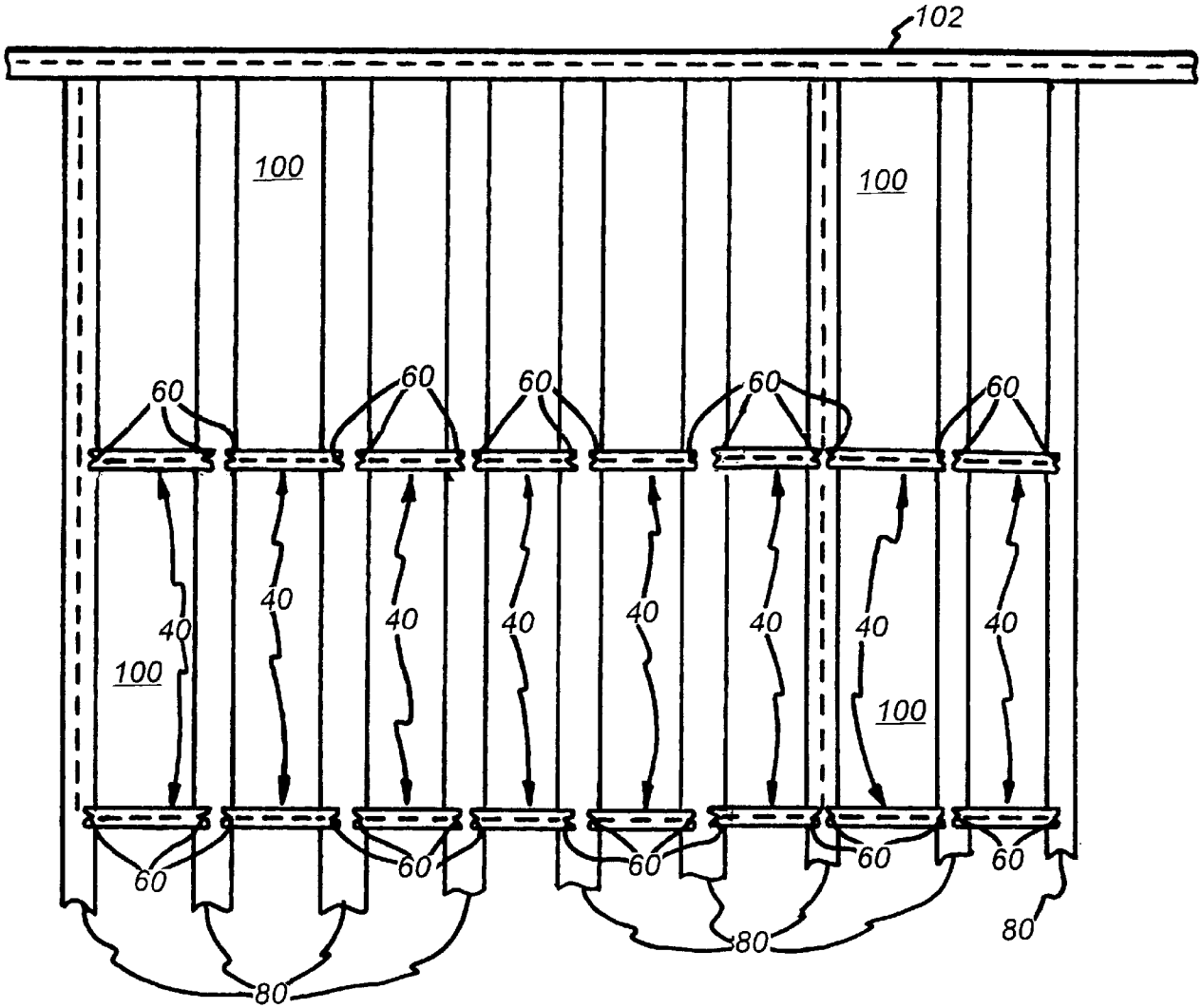
FIG. 6 is a top plan view of the joist spacer clips installed in a floor joist section according to this invention.

With further reference to FIGS. 5 and 6, installation of the clips 40 is now described. The clips 40 are positioned between adjacent joists 80 at various locations along the span of the joists. For example, clips 40 can be placed within the middle of the span, or at several locations along the span that are typically equidistant. Clips are typically inserted from the top of the joist downwardly before attachment of subflooring, but they can alternatively be inserted from below either before or after subfloor installation. The out-facing ends 60 (also termed "base ends") of each clip are seated so as to overlie the corresponding top face 82 of each joist. Once the ends 60 are seated on a joist face 82, nails 84 or other fasteners secure the ends to the tops of their respective joists. A notch 86 (FIGS. 2 and 4) is provided to guide and encompass the nails 84, thus restricting clip movement along the span of the joists. A variety of structures, including holes, slots and cutouts, can be used to receive nails and other fasteners. Note particularly that screws can be substituted for nails.

Each clip's draw bar 70 is typically already installed between the legs of each clip 40 when it is installed in the joistwork. The draw bar rests in an upwardly angled position as shown, for example, in FIG. 3 (and FIG. 5 in phantom). After the clip is seated and fastened to the joists, the draw bar 70 is rotated downwardly (curved arrow 90) from its angled position so that the end 72 of the draw bar engages the detents 74 in one of the leg Vs. The draw bar, thus, exerts outward pressure on each of the Vs that overcomes any spring pressure applied by the V's. As such each of the V's is flattened out to bear against an adjacent joist side. By appropriately adjusting each draw bar to apply pressure to a given joist side, the joists are maintained in a parallel relationship without a risk of curling (see pressure arrows 98). In other words, each draw bar may be initially brought into pressurable engagement with the joist sides, and then readjusted as needed to appropriately tighten all bars into a final orientation.

At some time following installation of the clips, either before or after final adjustment of each draw bar 70, the subfloor 100 (or ceiling drywall, etc.) is applied over the joistwork. Dashed lines in FIG. 6 indicate joints 102 between subfloor sheets (typically a tongue-and-groove structure). These joints usually occur in four-foot by eight-foot intervals. Clips can be located so that they underlie each joint. Appropriate adhesives can be applied to both the joists and tops of each clip bridging sections 44 to completely secure the subfloor at all contact points. Note that the actual position of a draw bar 70 may be somewhat non-horizontal as shown by the specific phantom orientation 104 in FIG. 5. In general, the length DL of the draw bar is chosen so that it is sufficient to apply pressure to each side of the clip (each V). This ensures that a positive pressure is maintained against each opposing joist. It is possible that a highly accurate joist arrangement may result in each draw bar being perfectly horizontal. More commonly, at least some draw bars will remain at a non-perpendicular angle to the adjacent joists to account for inaccurate spacing between joists at certain points along their span and the desire to enable further adjustment pressure to be applied to each draw bar. In addition, each side of the draw bar can be positioned variably along the series of detents 74. Hence, the actual angle of the draw bar with respect to each side of the clip is highly variable.

It should be clear that the draw bar occupies a minimum of space within the cavity between the adjacent joists. Still, the joists are firmly supported therebetween at their top faces by the bridging section 44 and adjacent their bottom faces by the draw bar. And the entire interior of the cavity remains open to allow clearance for mechanical systems.

It should also be clear that the clips can be manufactured from a variety of materials. For example, a standard structural-gauge galvanized steel can be used. Such steel is similar to that used for joist hangers (approximately one-sixteenth-inch thickness). Appropriate sheet metal-forming techniques can be used to define the various bends in the clip. Stiffening structures, such as internal ribs, or folded side wings can be provided to various portions of the clip to increase its internal rigidity. The fastener detents, while shown as a series of wells can comprise any features, including shoulders, ramps or slots. In addition, the draw bar, while shown as a solid metal bar, can comprise a channel member, hollow tube or any other structure that is somewhat rigid. Both ends of the draw bar can be freely moving or one can be fixed, and rotatable within a predetermined range about one of the clip legs. Alternatively, the clip and/or its components can be constructed in whole or in part from a composite such as glass filled nylon or another plastic. In addition, while a V structure is shown for the legs, the legs can be single sections that receive a draw bar structure at respective ends opposite to the bridging section ends.

Figure 7:
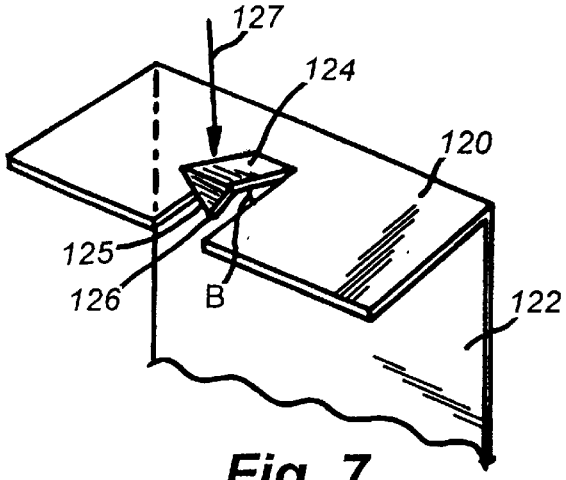
FIG. 7 is a partial perspective view of a joist spacer clip end with an integral securing spike according to an alternate embodiment of this invention.

FIG. 7 details an alternate embodiment for an end 120 of a sheet metal leg V-section 122 according to this invention. The end 120 includes a preformed tab 124 with a pointed spike 125 formed on its end. The spike and tab are cut from the overall end (using known sheet metal cutting techniques) and are bent upwardly into a raised position at an angle B that is sufficient to place the point 126 of the spike 125 above the plane of the end 120. In this way, the point does not engage the joist top during placement. After seating the ends 120 on a joist, the cabs 124 hammered against the joist to cause the spikes 125 to seat (see direction arrow 127) into the joist, thus securing the end 120 in the joist. The spikes remain seated in the joist top due to holding pressure exerted by the joist material and by permanent deformation of the tab. This structure removes the need for nails or other fasteners and speeds installation of clips. In an alternate embodiment, the outlying clip ends can each include one or more downward-pointed spikes that are preformed in the sheet metal (or other clip material). The spikes are in interfering contact with the joist tops during assembly, (e.g. beneath the plane of the end), and are secured by hammering the respective end into the joist top. The term "spike" is expressly contemplated to include such a fixed, interfering spike structure.

Figure 8:
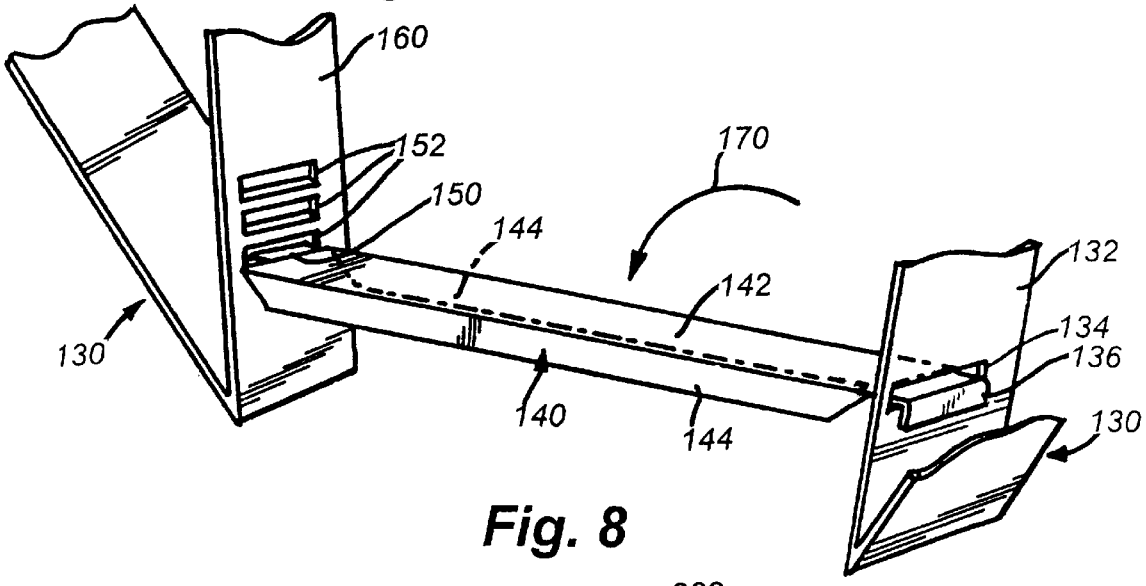
FIG. 8 is a partial perspective view of a fixed draw bar for use with the joist spacer clip according to an alternate embodiment of this invention.

As noted above, the draw bar can comprise a variety of shapes. FIG. 8 details a draw bar for a spacer clip in which each clip leg 130 defines a V-shape like that described above. However, in this embodiment, the inner leg section 132 includes a single slot 134 that receives a fixed draw bar end 136. Note that the bar end 136 is bent over to restrain the end within the slot 134 against pullout. The draw bar 140 comprises a sheet metal channel member with a top 142 and a pair of side wings 144 for rigidity. The end 150 of the draw bar, opposite the fixed end 136, engages a series of slots or detents 152 within the opposing inner section 160 that capture the bar end 150. In this manner, the draw bar 140 can be rotated (curved arrow 170) to provide variable pressure between the legs 130. The bar locks within the furthest downward detent based upon a given applied pressure.

Figure 9:
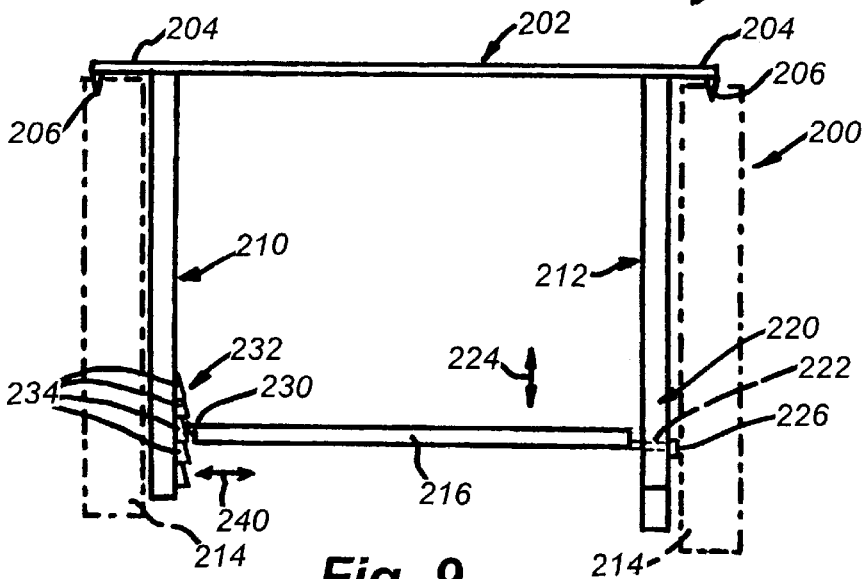
FIG. 9 is a somewhat schematic side view of a joist spacer clip according to another alternate embodiment of this invention.

FIG. 9 details an alternate embodiment of a spacer clip that can be formed from sheet metal or solid composites. The clip 200 includes a bridging section 202 with integral outlying bases or ends 204 for engaging joist tops. As used herein, note that the word "integral" means two or more parts or sections of the clip being formed from a single material piece—by, for example, molding, bending or cutting a flat piece of sheet steel to define distinct parts of the clip. Also note that integral spikes 206 (described generally above) are provided. These are driven into the joist tops. While a tight fit of legs to the joists is desired, it is mainly desired that the joists are engaged along their height opposite the bridging section 202. In general the tops of the joists, adjacent the bridging section are well secured against side-to-side movement by the subfloor itself in most instances. As such single-piece legs 210 and 212 are provided in this embodiment. The legs extend downwardly along the height of each joist 214 (shown in phantom), terminating above the bottom of each joist. Near the joist bottoms is located the draw bar 216 of this embodiment. The leg 212 includes a slot 220 in which a guide post 222 rides upwardly and downwardly (double arrow 224). A stop 226 prevents the guide post 222 from exiting the slot 220. The opposing draw bar end 230 rides along a ramp structure 232 formed on the opposite leg 210. The ramp structure 232 defines a series of steps 234 that are each progressively taller (e.g. extend further toward the opposing leg 212) along the downward direction. The steps are toothed so as to capture the bar end 230, and restrain it against upward movement. The steps 234 are also each angled so as to resist downward movement of the bar end absent applied pressure. After seating the clip 200 between the joists 214, the draw bar is slid downwardly so that the end 230 rides the ramp 234. The increasing height of the ramp causes the legs 210 and 212 to spread apart (double arrow 240) in response to the downward pressure on the bar until a maximum horizontal pressure is applied between the joists. The angle of the ramp and number of steps can be varied. In addition, it is contemplated that the sliding bar end 222 can be located in a fixed slot so that the bar rotates about the slot, rather than sliding upwardly and downwardly according to an alternate embodiment. See, for example, fixed end 134 in FIG. 8.

Figure 10:
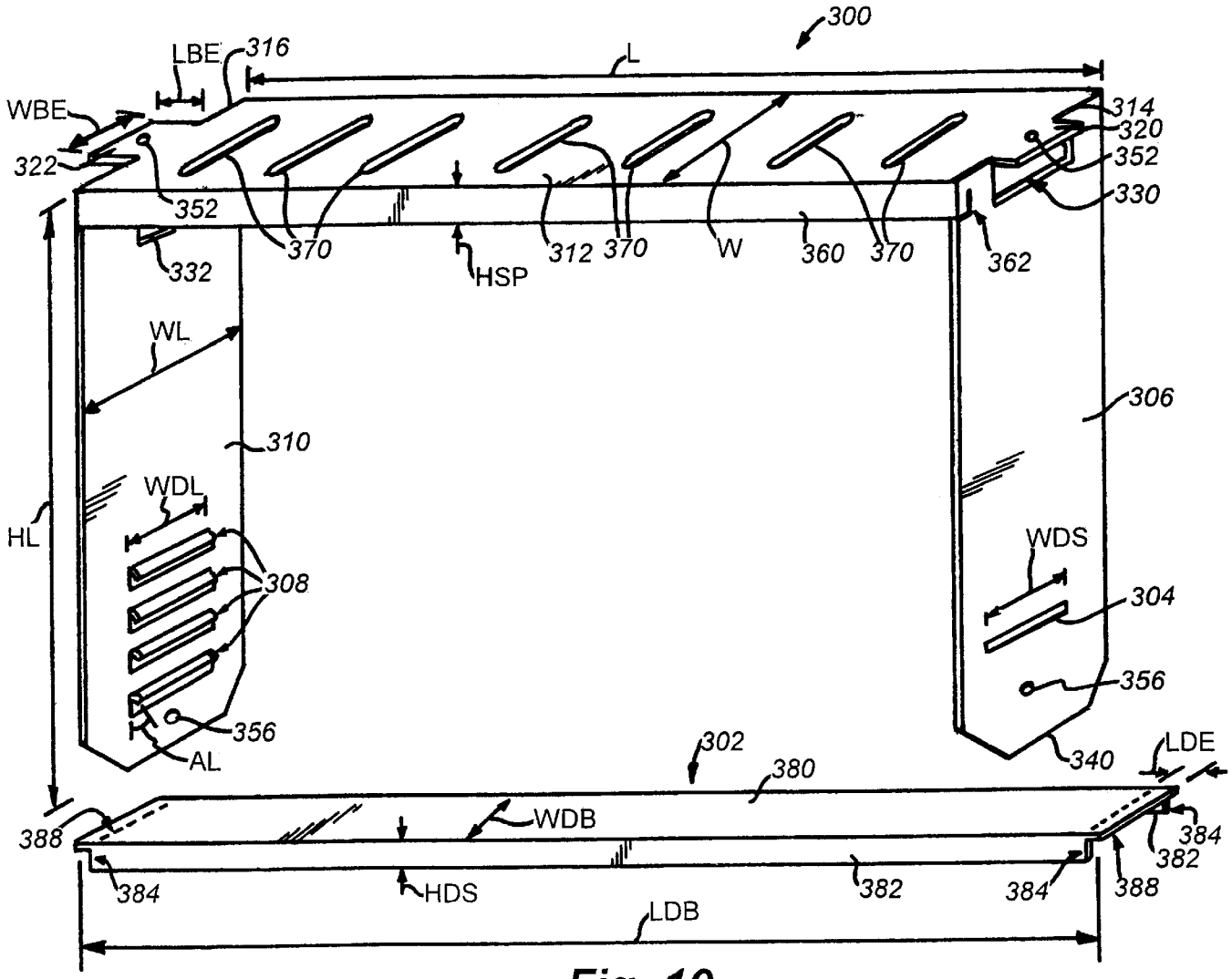
FIG. 10 is a perspective view of a joist spacer clip according to one preferred embodiment of this invention.
Figure 11:
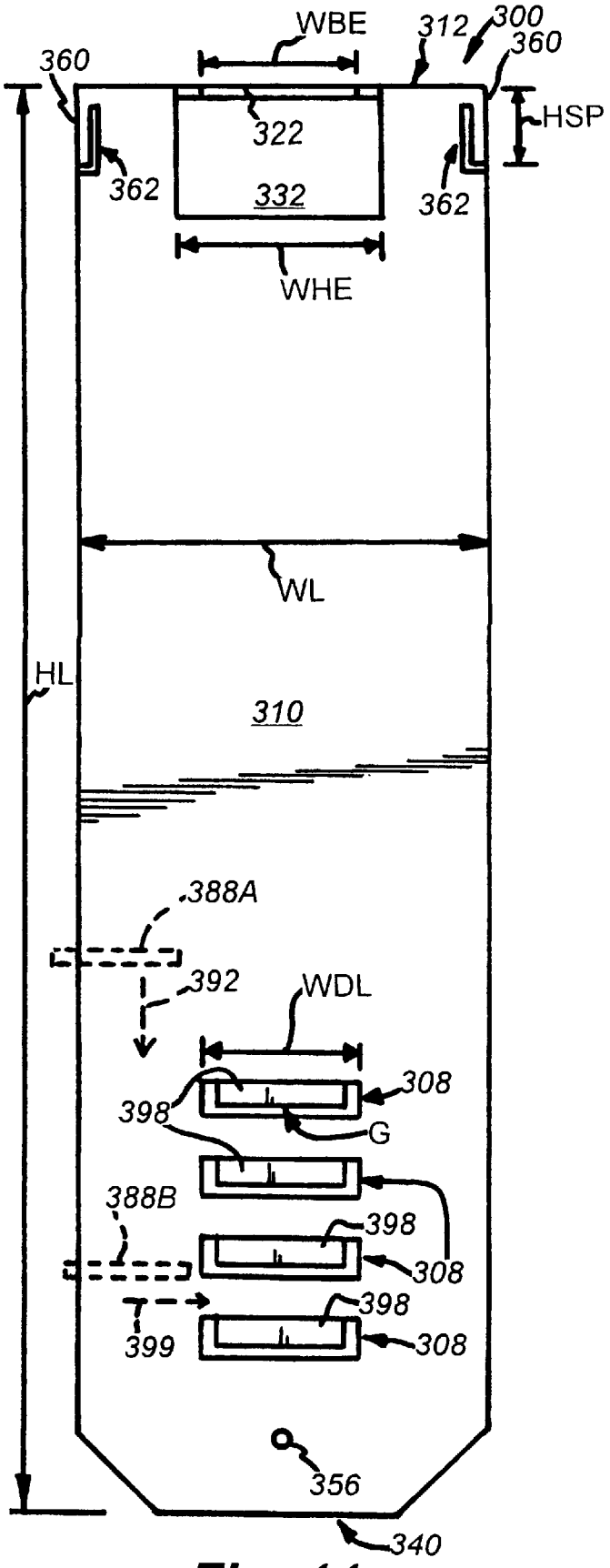
FIG. 11 is an external side view of the joist spacer clip of FIG. 10.
Figure 12:
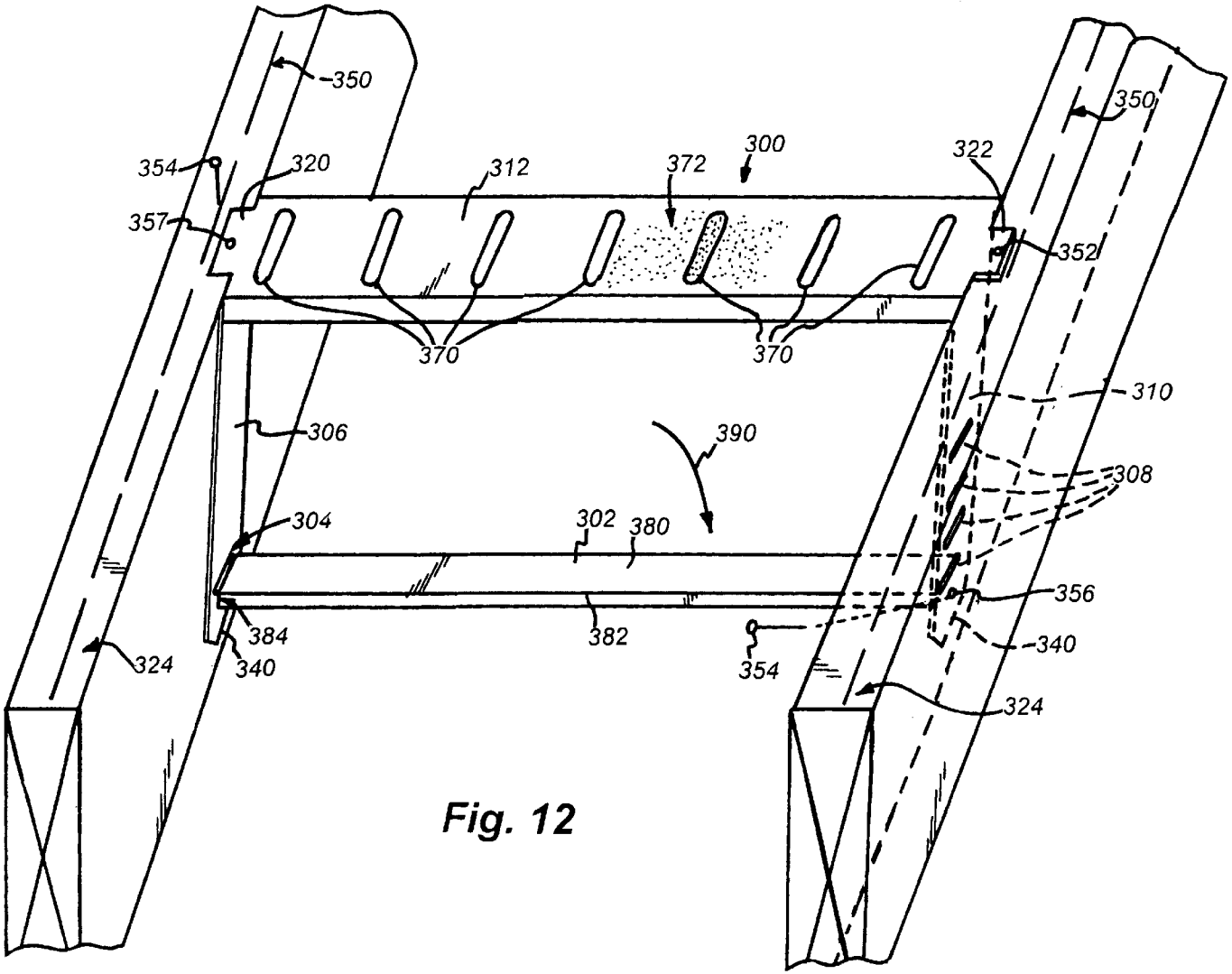
FIG. 12 is a perspective view of the joist spacer clip of FIG. 11 installed in an exemplary joist bay.

FIGS. 10–12 detail a preferred embodiment of the joist spacer clip 300 according to this invention. This spacer clip 300 of this embodiment includes a securing mechanism for the draw bar 302 similar to that described above in that it provides a single slot 304 at the bottom of one leg 306 as a bar pivot point and a series of spaced-apart slots 308 disposed vertically along the opposing leg 310 into which the draw bar 302 can be locked.

More particularly, the spacer clip 300 includes a central bridging section 312 that joins each of the two legs 306 and 310 at a pair of respective right-angle corner bends 314 and 316. In this embodiment, the corner bends 314 and 316 are divided by a continuous central portion that is an outward extension of the top surface of the central bridging section 312-each central portion thereby defining a respective base end 320 and 322 for supporting the spacer clip 300 on adjacent joist tops (see joist tops 324 in FIG. 12). Being manufactured from a single piece of approximately 1/16-inch thickness galvanized sheet steel in this embodiment, the central bridging section 312, legs 306, 310 and base ends 320, 322 are all formed integrally by conventional sheet metal cutting and bending processes. With reference particularly to FIGS. 10 and 11, the base ends 320, 322 are cut away from the leg sections prior to bending leaving the respective central apertures 330, 332. Enough material remains on each side of the aperture 330, 332 to provide sufficient support for the underlying leg 306, 310. In this embodiment, each base end 320, 322 has a width WBE of approximately 1 inch. The aperture width WHE is greater than 1 inch. The width W of the central bridging section and width WL of each leg is approximately 2½ inches. In this embodiment, approximately ⅝ inch of width remains on each side of a respective aperture. Of course, these dimensions can be varied significantly according to this invention. The vertical height HL of each leg 306, 310 from the top surface of the central bridging section 312 to the bottom leg tip 340 is approximately 9 inches, but this is significantly variable depending upon the height of the joist bays to be filled, as already discussed.

The outward extension length LBE of each base end 320, 322 is approximately ¾ inch. This extended length provides sufficient area to adequately support the spacer clip 300 on the joist tops 324 (FIG. 12), but places each base end short of the joist center line 350. As discussed above, this enables the spacer clips to be located in an in-line, side-by-side arrangement within the joist bays free of interference between spacer clip base ends. See generally the arrangement in FIG. 6. Alternatively, if a staggered joist spacer clip arrangement within adjacent joist bays is acceptable, the base ends can have an extension length that places them beyond the joist center lines.

Note that each base end 320, 322 includes a fastener hole 352 arranged to receive a nail 354 (FIG. 12) or other fastener. It is expressly contemplated that another fastener system such as the preformed spike (see FIG. 9) or bendable tab spike (see FIG. 7), described above, can be provided to the base end of this embodiment. Note that fastener is not per se required in all applications, since pressure applied by overlaid subflooring/decking and adhesives generally secure each spacer clip against upward and lateral movement within a joist bay. Similar fastener holes 356 are provided adjacent the bottom of each leg 306, 310. Again, these can, alternatively, be spikes or bendable tab spikes as shown above.

The overall length L of the central bridging section 312, between bends 314 and 316 is approximately 14⅜ to 14½ inches, thus arranged to fit snugly within a bay formed between conventional dimensioned "two-by" lumber joists. As discussed previously, this length L can be varied widely to accommodate bays that conform to different spacing conventions or different joist widths, such as "doubled-up" joist pairs. While it is contemplated that the spacer clip of this and other embodiments can be manufactured to various predetermined, fixed sizes, a system for providing a universally variable-length central bridging section is described further below.

With further reference to the central bridging section 312 of this embodiment, it includes a pair of integrally formed side plates 360 as generally discussed above. The side plates have a height HSP of approximately ⅝ inch in this embodiment and are bent at right angles to the top surface of the central bridging section 312. The side plates extend the full length (L) of the central bridging section and therefore nest within precut wells 362 (see FIG. 11) formed on the upper edges of each leg 306, 310, prior to bending. This arrangement yields a very sturdy beam structure for the spacer clip 300.

The central bridging section 312 also includes a series of slots 370, disposed along its surface. Holes, or other perforations can be substituted. The slots 370 enable adhesive 372 (see FIG. 12) to flow and form a tight overlapping bond with the overlaid subfloor. The slots 370 (or equivalent apertures) can also be used to attach fasteners to the subfloor from below in certain instances. Again, since the thickness (gauge) of the spacer clip's material is relatively thin (approximately 1/16 inch or less), it is not a significant step-up from the surrounding joists. Compression of the joists and subfloor should enable construction of a sturdy, essentially flat subfloor once fasteners are applied between the subfloor and joists.

It is typically desirable that the top surface of the central bridging section engage the subfloor. However, in an alternate embodiment, lateral stability alone it achieved, and the step-up is alleviated, by providing minimal or no outward extension of the base ends. As such spacer clips would seat between bays based upon fasteners placed through the legs of the spacer clip or through a friction fit. Alternately, the base ends can be sized to extend approximately 1/8 inch outwardly from the bends. As such the base ends would prevent the spacer clip from dropping through the bay, but would rest on the relieved, rounded-over edge commonly found on dimensioned "two-by" lumber.

With reference also to the draw bar 302, the locking mechanism of the spacer clip is now described in detail. The draw bar 302 according to this embodiment is formed of approximately 1/16 inch thickness (gauge) galvanized sheet steel. It includes a main top section 380 having a total length of extension LDB of approximately 14¾ inches. The width WDB of the main top section 380 is approximately 1 to 1⅛ inches in this embodiment. Likewise the main top section is joined to a pair of right-angle side plates 382 formed using conventional sheet metal bending techniques. The draw bar side plates 382 add structural rigidity to the draw bar. The draw bar side plates 382 have a height HDB of approximately ¼ inch. The side plates have perpendicular ends 384 that are inwardly offset from the ends of the main top section 380 by a distance LDE of approximately 1/16 to 1/8 inch. This defines end extensions 388 on the main top section 380 each having a respective extension length of LDE. The exact overall length of the bar and offset of the side plates can be varied based upon the desired securing angle of the bar in a secured orientation in the spacer clip. The dimensions given hereinabove are for a conventional joist bay arrangement in which the bar is at or near horizontal orientation ( approximately parallel with the central bridging section). In this orientation the offset of the side plates is chosen to barely contact the legs for maximum beam strength. The offset, however can be greater, or the ends 384 can define an inward non-perpendicular if they are likely to overly interfere with downward motion (see curved arrow 390 in FIG. 12) of the draw bar into a locked position during installation of the spacer clip in the joist bay.

The joist spacer clip legs 306, 310 according to this embodiment are adapted to receive the bar at a plurality of rotational positions. The leg 306 includes a fixed slot 304 that receives one outwardly projecting "extension end" 388 of the draw bar 302. The preferred width of the slot WDS is slightly greater than 1 inch. The width of the extension end 388 is, likewise equal to or slightly less than 1 inch to closely, but freely receive the extension end 388 within the leg slot 304. The height (vertically) of the slight is slightly greater than the thickness of the draw bar extension end 388 so as to allow rotation of the bar within the slot. As described previously, during a typical installation, the clip is first placed into the joist bay from above. Fasteners (where appropriate) are applied between the spacer clip and adjacent joists, and the draw bar extension end 388 is then inserted into the slot 304 with the draw bar rotated so that its opposing end is nearer to the bottom surface of the central bridging section. The width of the draw bar WDB is less than that of the leg WL. With reference particularly to FIG. 11, the relative width of the draw bar versus the leg enables the unsecured extension end (388A) of the draw bar to ride slidably along the face of the multi-slot leg 310 without coming into contact with the series of slots 308 (see phantom end 388A and downward arrow 392). This enables the bar to be levered freely to a rotational location that applies desired pressure between adjacent joists with minimal frictional resistance due to the sliding of the extension end against the hard, flat surface of the leg. Clearly, only a portion of the extension end need contact the side of the leg, the remaining end can overlie the outer edge of the leg (see phantom end 388A and 388B) as it is moved downwardly into a final pressurable position—so long as it does not contact an obstruction on the underlying joist as it is moved therealong.

The plurality of slots 308 define a set of "louvers" 398 that are angled inwardly (toward the opposing leg 306) at an angle AL (see FIG. 10) of approximately 5 degrees according to this embodiment. This angle can be varied substantially. The louvers 398 are cut and bent according to conventional techniques. The slots 308 define a width WDL of approximately 1 inch to closely seat the respective draw bar extension end. The louvers 398 are arranged to define a gap G sufficient to receive the extension end 388 thereinto. As detailed in FIG. 11 the phantom extension end 388B, having been slid downwardly (phantom arrow 392) to an appropriate position, can now be slid in a widthwise direction (Phantom arrow 399) so that the extension end (388B) engages the selected gap G. The angled louver 398 prevents upward movement of the received extension end 388 once it is presurable secured thereinto.

According to this embodiment, there are four slots, however, the number of slots can vary. The lowest slot 308 and single opposing slot 304 are located approximately 1 inch above the bottom 340 of each leg 306,310. The plurality of slots are each spaced approximately ½ inch apart. The spacing thereof can be varied as well. Note that other formations such as wells, raised ramps and/or detents, formed on the surface of the leg, can be used instead of through-cut slots as detailed in this embodiment, the terms "locking structure" and "slot" should be taken to include such formations.

As noted above, it is also contemplated that the central bridging section, according to any of the embodiments described herein, can comprise two or more parts that telescope and lock using, for example a ratcheting rack assembly or locking bolt system within a predetermined range. This allows unconventionally spaced joists to be accommodated.

Figure 13:
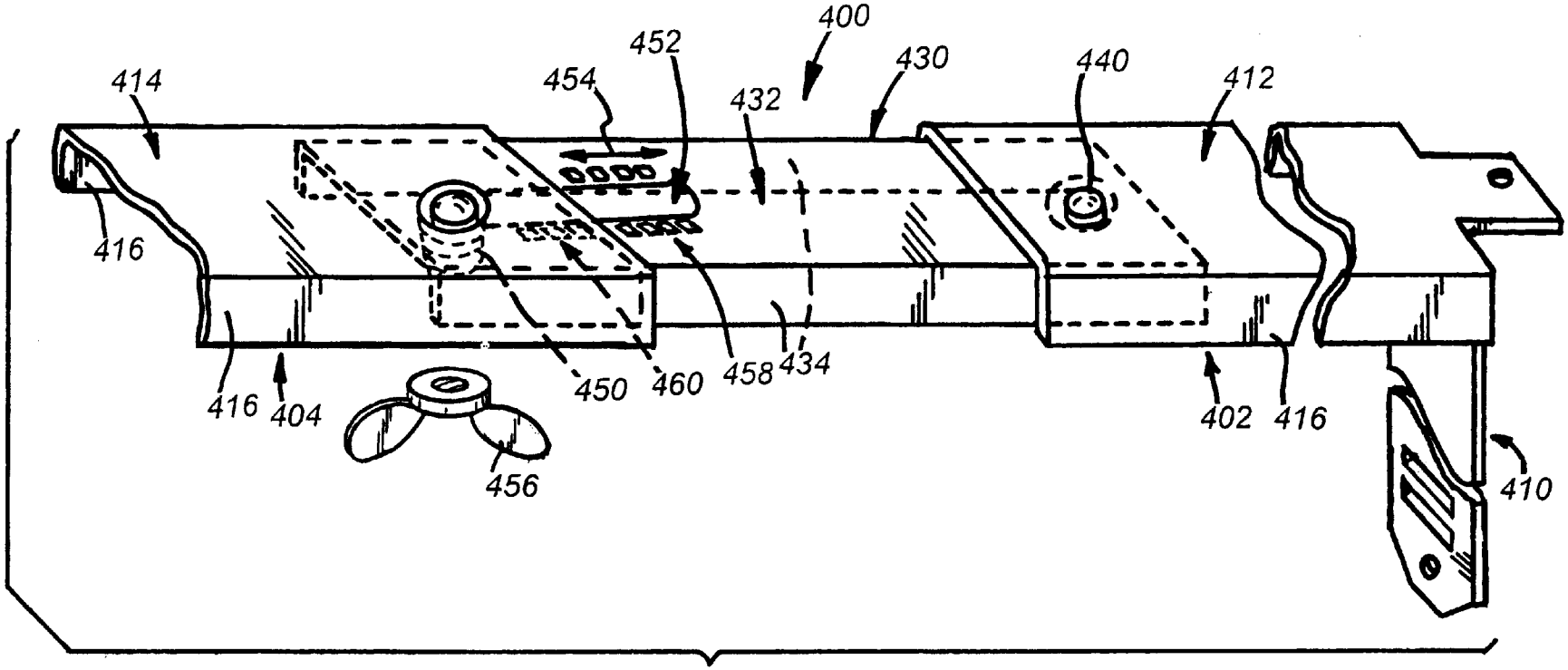
FIG. 13 is a broken exposed perspective view of a variable length central bridging section for use in the joist spacer clips according to this invention.

With particular reference to FIG. 13, a variable-length central bridging section 400 is shown. The bridging section 400 includes a pair of bridging halves 402 and 404, each interconnected with a respective leg (such as leg 410) in accordance with any of the embodiments described above. The halves 402, 404 each include a respective top surface 412, 414 and an appropriate pair of integrally formed (bent) right-angle side plates for added rigidity. Top surface slots and/or other formations as described above can also be applied to each of the halves 402, 404. Between the halves 402, 404 is mounted a slide section 430. The slide section includes a top section 432 and a pair of integrally formed/bent side plates 434. The halves 402, 404 and slide section 430 are each constructed from a sturdy material such as those described above. In particular sheet steel can be used. The width of the pieces and length of the legs can be similar to that described above. The central section 430 differs slightly in its dimensions in that is sized and arranged to nest within the bottom of each of the halves 402, 404. As shown, the slide section 430 is fixedly attached to the half 402 by, a weld or flattened rivet 440. The rivet projects minimally, or not at all, above the top surface so that it does not significantly interfere with the subfloor. The slide section 430 engages, at its opposite end, a threaded stud 450 that projects from the bottom of the half 404. The stud rides in an elongated slot 452 cut through the top surface 432 to enable the slide section 430 to move linearly (double arrow 454) with respect to the half 404. In this way, the halves 402 and 404 can be moved toward and away from each other to adjust the associated leg spacing within a predetermined range. The length of the slot is variable depending upon the desired range of movement. Similarly, the length of the slide section is variable. A mating wing nut 456 is used to pressurably lock the slide section in a desired position with respect to the half 414. As an added feature, mating serrations, teeth or other friction-inducing structures 458 and 460 can be provided to the respective facing surfaces of the slide section 430 and half 404. Note that a stud and slot can be provided to both halves/ends of the slide section according to an alternate embodiment.

A sufficient overlap should exist between the nested slide section 430 and halves 402, 404 at all positions to ensure rigidity at all adjustment positions. Note that a separate slide section reduces interference with the subfloor by placing the adjustment mechanism beneath the plane of the top surface of each half. An integral, lowered slide section can be formed in one of the halves, for mating with the other half according to an alternate embodiment, or a different shape of interconnection slide can be used. Likewise, where interference with the subfloor is not a particular concern, each half can be arranged to directly nest with and lock with the other half with an overlap of one halves' top surface relative to the other halves' top surface. Refer, for example, to the description of FIG. 14 below.

Where an adjustable central bridging section is used, a set of different-sized draw bars can be employed to approximate the adjusted length and accommodate differences by locking the draw bar at a non-horizontal orientation with respect to the central bridging section. Additional locking detents or slots can be provided to increase the number of possible locking positions/angles. Alternatively, an associated adjustable-length draw bar, as detailed in FIG. 14 can be used.

Figure 14:
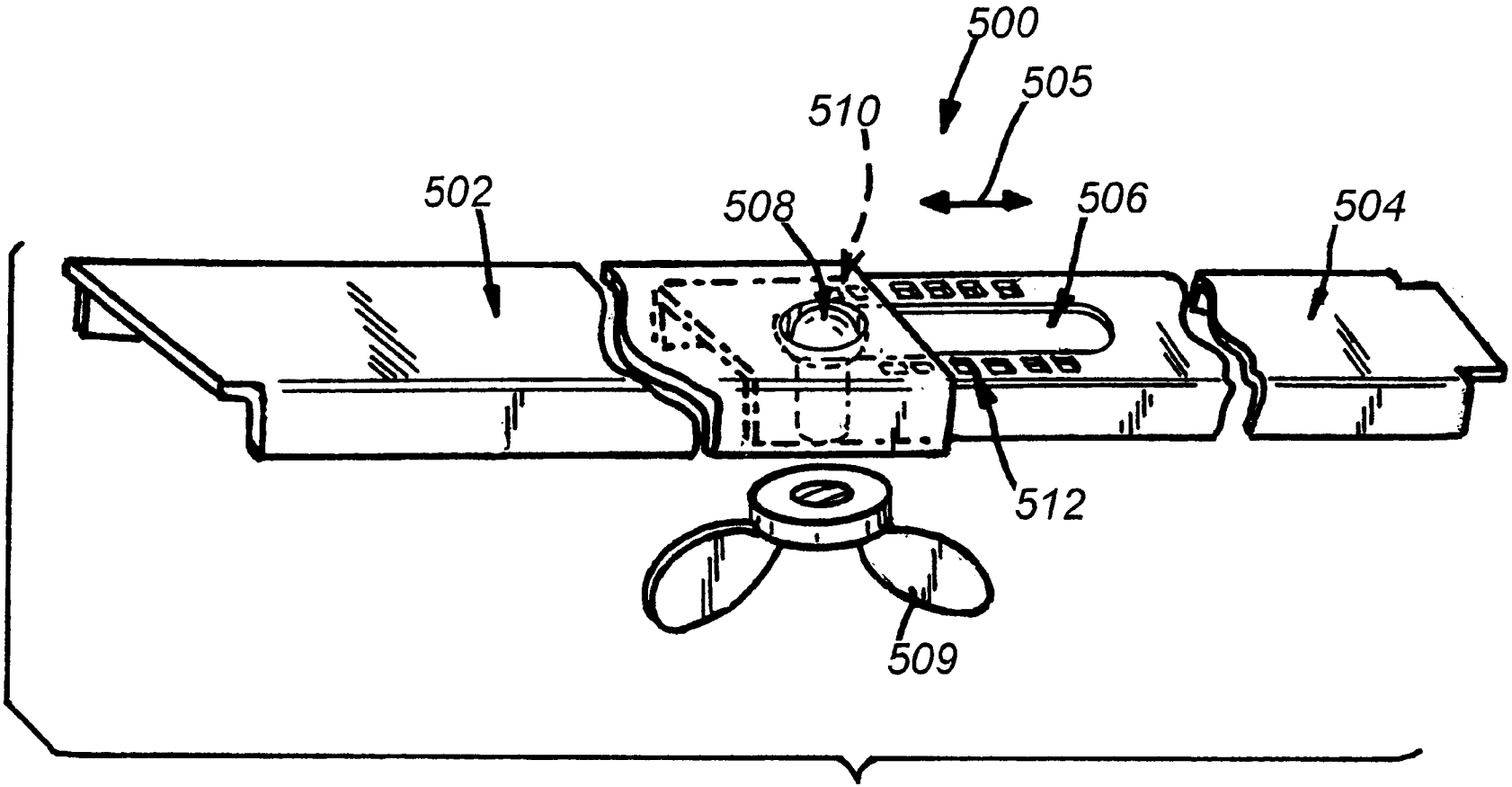
FIG. 14 is a broken exposed perspective view of a variable length draw bar for use in the joist spacer clips according to this invention.

The adjustable draw bar 500 of FIG. 14 includes a pair of nested bar sections 502 and 504. The bar section 502 is sized to overly and closely nest with the bar section 504. To facilitate this, the bar section 502 is generally wider than the section 504 whereby the inner width of the bar section 502 is slightly greater than the outer width of the bar section 504. One bar section 502 includes a slot 506 and the other bar section 504 includes a stud or bolt assembly 508 with a tightening nut 509. The bar sections 502, 504 slide toward and away from each other (double arrow 505) within a range of movement defined by the length of the slot 506. The bolt assembly 508 is tightened to permanently secure the bar sections 502, 504 at the selected adjustment length. Friction-inducing surfaces 510 and 512 can be formed on each respective mating face as described above. It is expressly contemplated that the adjustable draw bar 500 can also be used in conjunction with the fixed-length joist spacer clips described herein.

The foregoing has been a detailed description of certain embodiments of the invention. Various modifications and additions can be made without departing from the spirit and scope of the invention. For example, the placement of spacer clips along joists can be varied from that shown. Joist pacer clips can be located between subfloor joints and/or can be staggered depending upon the particular floor geometry. Additional spacer clips can be located between standard mounting positions where further pressure must be applied to maintain joists and alignment. The length (vertical height) of the spacer clip legs can be varied substantially depending upon the height of the joists. In some embodiments more than one draw bar can be used. Such draw bars can be provided at different spacings along the clip legs. Additional structures can be provided to the clips to aid in their securing to joists and to help guide various mechanical systems such as wires and pipes. These can include fixed chases, knock-out holes and/or bendable guide dogs. The detents or slots used to lock joists in place can be varied, so long as they adequately secure the draw bar against future disengagement. Locations for permanent securing structures such as lock pins or nails can also be provided. Additionally, one or both of the legs of the clip can generally define ramps that are closer together at one portion of the height than another so that the draw bar can be moved upwardly/downwardly to vary the pressure between the legs. Finally, while a downward rotation/movement is employed to secure each draw bar in the above-described embodiments, an upward pressure (toward the central bridging section) can be applied according to an alternate embodiment. Accordingly, this description is meant to be taken only by way of example and not to otherwise limit the scope of the invention.

What is claimed is:

1. A spacer clip for maintaining spacing between side-by-side wooden joists, each of the joists defining a predetermined height between joist tops and joist bottoms and a each of the side-by-side joists defining a predetermined spacing distance with respect to adjacent side-by-side joists, the spacer clip comprising:

a bridging section having opposing bridging section ends that are spaced at the predetermined spacing distance, and including a flat top surface and side plates interconnected with the flat top surface and projecting transversely to a plane defined by the flat top surface, the side plates extending between the opposing bridging section ends for providing rigidity to the bridging section;

a first leg and a second leg each respectively extending transversely to the flat top surface of the bridging section from each of the opposing bridging section ends to a respective lower end and the first leg and the second leg each respectively extending in a leg extension direction a distance between the opposing bridging section ends and the lower ends that is less than the predetermined height, each of the first leg and the second leg being flexibly movable away from each other at each lower end;

a pivot slot in the first leg adjacent the lower end thereof a plurality of locking slots in the second leg adjacent the lower end thereof located at spaced-apart positions along the second leg in a direction taken in the leg extension direction a pair of base ends, each extending outwardly of each of the bridging section ends, respectively, and each of the base ends defining a flat top surface that is aligned with the plane defined by flat top surface of the bridging section; and a draw bar having a first projecting end projecting outwardly from a first draw bar end, the first projecting end pivotally engaging the pivot slot and a second projecting end projecting outwardly from a second draw bar ends opposite the first draw bar end, the second projecting end removably seating in and retained by, each of the plurality of locking slots so as to provide variable outward movement of the lower end of the first leg with respect to the lower end of the second leg, and wherein distance between the first draw bar end and the second draw bar end is greater than the predetermined spacing distance.

2. The clip as set forth in claim 1 wherein each of the base ends includes a respective structure for receiving a joist-engaging fastener.

3. The clip as set forth in claim 1 wherein each of the base ends includes a respective integrally formed joist-engaging spike.

4. The clip as set forth in claim 1 wherein the plurality of slots include a slot having an angled surface that defines therebelow a gap for seating the first projecting end therein and that projects inwardly toward a center of the clip to further overlie a surface of the draw bar whereby unseating of the first projecting end from the slot is further resisted.

5. The clip as set forth in claim 1 wherein the bridging section and each of the first leg and the second leg together comprises an integral structure formed from a single piece of sheet metal having a respective corner bend between the bridging section and each of the first leg and the second leg.

6. The clip as set forth in claim 1 wherein each of the base ends is formed integrally from the single piece of sheet metal as an outward extension, from the respective comer bend, of the bridging section, whereby an aperture is defined in each of the legs adjacent the respective base end from which the respective base end is cut-out.

7. The clip as set forth in claim 1 wherein the draw bar comprises a planar top surface that extends to and defines each of the first projecting end and the second projecting end, and a pair of integrally formed side plates for stiffening the planar top surface.

8. The clip as set forth in claim 1 wherein the flat top surface bridging section includes a top surface including a plurality of apertures defined thereon.

* * * * *